United States Patent [19]

Gagnebin et al.

[11] 4,364,668

[45] Dec. 21, 1982

[54] TIMEPIECE WITH SECONDS DISPLAY ON DEMAND

[75] Inventors: Pierre-Luc Gagnebin, Bienne; Pierre Ginalski, St-Maurice, both of Switzerland

[73] Assignee: Societe Suisse pour l'Industrie Horlogere Management Services S.A., Bienne, Switzerland

[21] Appl. No.: 195,217

[22] Filed: Oct. 7, 1980

[30] Foreign Application Priority Data

Oct. 9, 1979 [FR] France ..... 79 25528

[51] Int. Cl.[3] ..... G04B 19/04; G04F 8/00

[52] U.S. Cl. ..... 368/80; 368/111

[58] Field of Search ..... 368/29, 62, 66, 76, 368/80, 85-87, 155-160, 185, 187, 188, 202, 223, 228; 318/696

[56] References Cited

U.S. PATENT DOCUMENTS

| | | | |
|---|---|---|---|
| 4,259,736 | 3/1981 | Berney | 368/62 |
| 4,259,737 | 3/1981 | Berney | 368/66 |
| 4,266,288 | 5/1981 | Berney | 368/28 |

FOREIGN PATENT DOCUMENTS

| | | |
|---|---|---|
| 2398334 | 2/1979 | France . |
| 2404250 | 4/1979 | France . |

OTHER PUBLICATIONS

Patent Abstracts of Japan, vol. 2, No. 109, Sep. 9, 1978, p. 6033E78 and JP-A-53 76 070 (Daini Seikosha KK), 06-07-1978.

*Primary Examiner*—Vit W. Miska

*Attorney, Agent, or Firm*—Griffin, Branigan & Butler

[57] ABSTRACT

An analog display timepiece includes an hours hand and a minutes hand. A control in association with electronic means enables transformation of the minutes hand into a seconds hand and the hours hand into a minutes hand which advances through an angle of 30° per minute. In one version a first operation of the control positions the hands at noon and stops them. A second operation starts the timing operation with a span of 12×60 seconds. A third operation stops the timing and a fourth operation returns the hands to display the actual time of day following which operation is normal.

11 Claims, 4 Drawing Figures

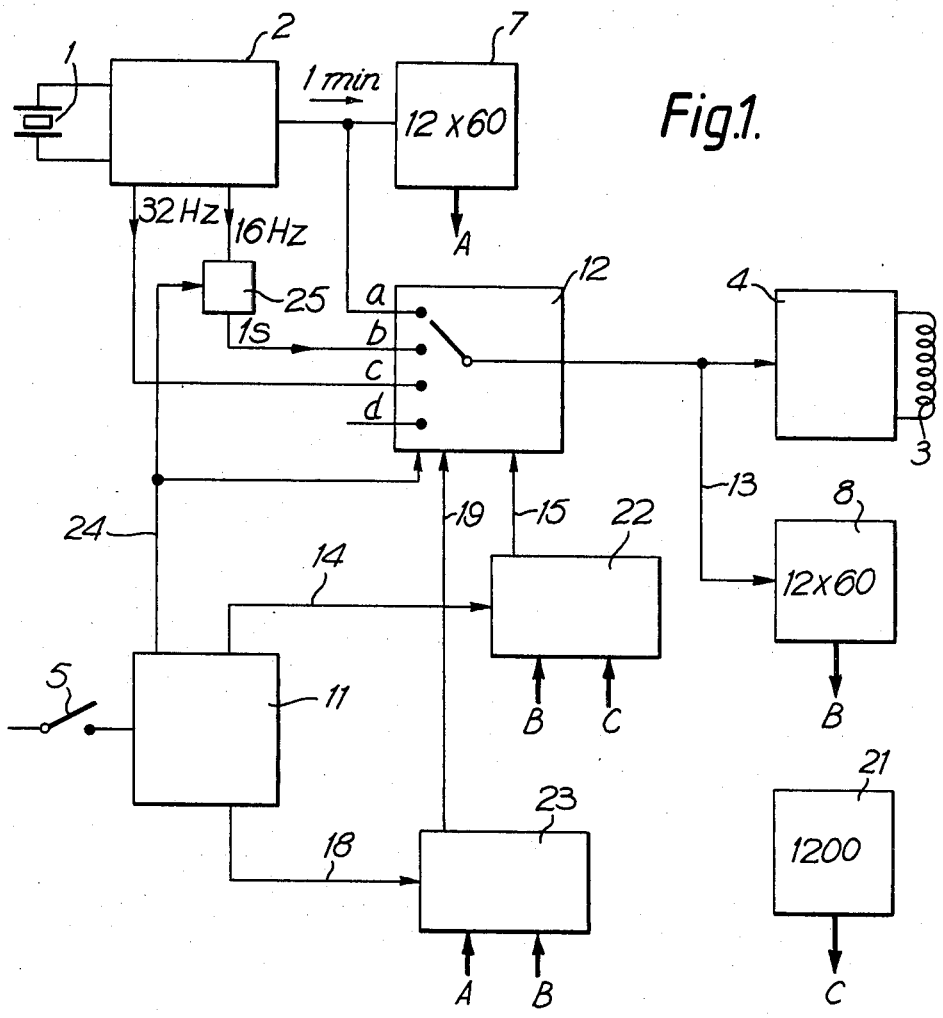
Fig.1.
Fig.2a.
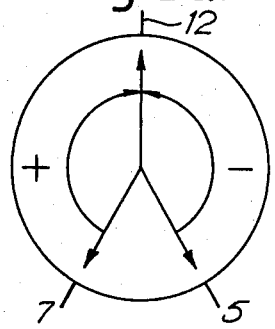
Fig.2b.
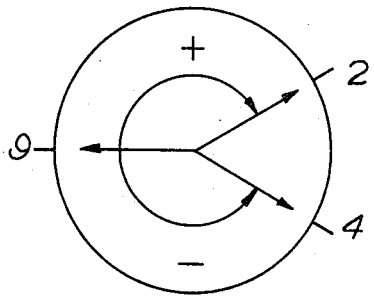

TIMEPIECE WITH SECONDS DISPLAY ON DEMAND

BACKGROUND OF THE INVENTION

The object of the present invention is to provide a timepiece including a time standard, a divider circuit, at least one electric motor, a pulse forming circuit to provide for forward or reverse rotation of said motor a gear train, a display arrangement including an hours hand and a minutes hand and a dial divided into 60 divisions.

Timepieces of the above mentioned type are known. In U.S. Pat. No. 4,182,114 is described a timepiece movement including an electric motor and a planetary dial train having special advantages when utilized in wrist-watches of extremely small dimensions. In this arrangement there is no seconds hand nor has a date display been provided in order to enable a considerable reduction of the overall dimensions of the timepiece. Moreover since the minutes hand is driven directly by the stepping motor, such motor may be energized less often than when a seconds hand is provided thereby effecting a reduction in the energy consumption so that one may employ smaller batteries. These several advantages combine furthermore with elimination of the supporting base plate, thanks to the suppression of the numerous mechanical pieces normally required for correction of timepiece movements of the prior art and enable one to achieve a special styling which may find application in a ladies wrist-watch or for fine jewellery.

The absence of seconds hand in such a movement may be considered as a negative type modification but since hereby one may achieve a significant reduction in the dimensions of the watch it may nevertheless be considered as an improvement. However circumstances arise where a seconds hand can be useful even should this be only during a limited time. For instance a medical assistant may wish to measure the pulse of a patient and everyone may occasionally wish to carry out time measuring operations.

The idea of the present invention thus consists in being able to use at least one of the two hands in order to momentarily display the second, thus adding to the watch on additional performance without increasing its dimensions nor increasing its energy consumption significantly. In the particular case one may realise a chronographic function in the full sense of the term this being achieved by means of a single manual control which may be present in the form of a push button.

The French patent application No. 2 404 250 has already proposed a timepiece having a minutes hand and an hours hand adapted such that they may display various functions in addition to those for which they are initially intended. By means of a push button $P_1$ it is possible to display through use of the minutes hand, successively, the date, the month, the hour and the second. At the same time the internal circuit of the timepiece is arranged in order to correct the different mentioned functions, the correction being obtained through use of another push button $P_2$. This patent application has thus as an essential purpose the correction of the time indications and neither proposes nor suggests, as in the present case, a true chronograph function where through a first action on a push button the hands are set at noon, in a second operation the minutes hand becomes a seconds hand, and in a third action the hands are stopped in order to permit reading of the elapsed time. Finally in a fourth action the hands are restored to their original function in order to indicate hours and minutes in real time. Moreover as has already been said, the watch of the present invention has a very simple movement devoid of all internal contacts which need be operated by a cams coupled with the hands as has been the case in the cited patent application. Finally the time setting of the watch of the present invention is achieved through means independent of those used for obtained the chronograph function, such correction means being those described for instance in the U.S. Pat. No. 4,185,453 assigned to the present assignee. In this patent correction of seconds is achieved without the necessity of a seconds hand for display thereof as is the case in respect of French application No. 2 404 250 mentioned above which employs a hand normally indicating minutes to display seconds in order to enable correction of the seconds display.

It is the purpose of this invention to bring initially the hours and minutes hand of a timepiece not having a seconds hand to noon before having them assume the function of minutes and seconds hands respectively in order to be able to perform a chronograph function.

These purposes are obtained thanks to the claimed means.

BRIEF DESCRIPTION OF THE DRAWINGS

FIG. 1 represents a schematic diagram of the internal circuit of the timepiece according to a first form of the invention.

FIGS. 2*a* and 2*b* show the movement patterns of the hands if the internal circuit of the timepiece is obtained according to the principle illustrated in FIG. 3.

DETAILED DESCRIPTION OF THE DRAWINGS

Figure 3:
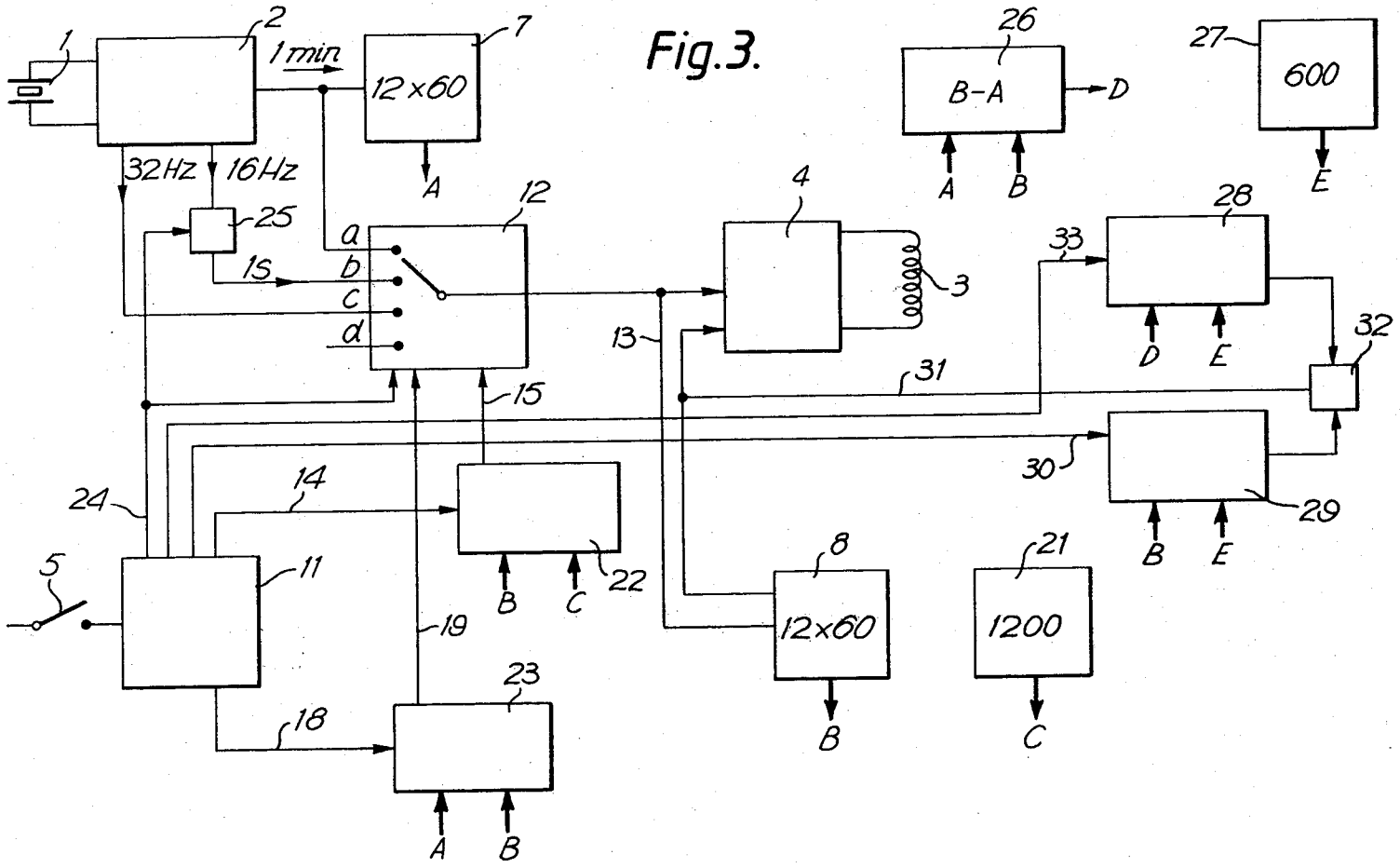
FIG. 3 represents a schematic drawing of the internal circuit of a timepiece according to a second form of the invention.

According to the invention there is added to a watch having only a minutes and an hours hands a chronographic function in the full sense of the term. The timepiece is provided with a control means in a form of a push button. During normal operation the timepiece displays hours and minutes in real time and has no seconds hand. Upon acting a first time on the push button the hands are rapidly positioned at noon and remain there until this push button is activated a second time. From this moment the minutes hand becomes a hand which progresses through one division of 6° per second while the hours hand becomes a hand indicating minutes and progresses through an angle of 30° per minute. A third activation of the push button stops the chronograph in order to permit reading of the elapsed time. It will be understood that the chronograph thus constituted has a total range of 12 minutes, the seconds being read on the division of minutes (0–60) and the minutes being read on the division of hours (0–12). Finally a fourth actuation of the push button rapidly brings the the hands to the positions corresponding to the real time and after this return to the actual time of day they will continue to display hours and minutes. Two possible forms are foreseen here in order to achieve the purpose exposed above and in accordance with the time required by the hands to arrive rapidly at their start positions and thereafter return to their normal position and function.

FIG. 1 represents the basic block of a circuit permitting the realisation of a first form of the invention.

The circuit includes a time base 1 coupled to a frequency divider 2 which provides signals at 32 Hz, 16 Hz and at one minute, and a motor of which only the exciting winding 3 is shown and which receives control pulses from a pulse forming circuit 4.

According to the invention the circuit includes moreover a manual control means 5 acting on a sequencing circuit 11, a frequency selector 12, a first counter 7 stocking data for the hour and the minute of real time, a second counter 8 stocking data corresponding to the position to the hands, a memory 21 storing data for the noon reference on the dial of the timepiece, a first comparator 22 comparing the contents of the second counter 8 with contents of the memory 21 and a second comparator 23 comparing the contents of the first counter 7 with the contents of the second counter 8. The elements of the circuit are coupled together as shown on the schematic of FIG. 1. Five stages of operation may be distinguished.

First stage: normal display of hours and minutes of the time of day. Selector 12 receives no information from comparators 22, 23. It is then at position a and transmits pulses concerning real time each minute to motor 3 via the pulse forming circuit 4. The minutes hand thus advances one step per minute. The reference to its position as well as the position of the hours hand is also stored in counter 8 via line 13. Counter 8 has a capacity of $12\times60$.

Second stage: positioning of the hands at noon. The control means 5 is actuated for the first time. The signal developed thereby causes the sequencer 11 to switch and provides an enable to comparator 22 via line 14. On the one hand selector 12 is switched to c via line 15, the result being to provide motor 3 with a rapid advance signal at 32 Hz for the minutes hand. On the other hand comparator 22 compares contents C of memory 21 (containing reference data to the noon position) with the contents B of counter 8 (containing reference data to the position of the hands) and causes the hands to advance until B=C. At this instant the comparator 22 provides a switching signal via line 15 to selector 12 which advances to position d. The motor 3 thereafter receives no further pulses and stops.

Third stage: display of seconds. Control means 5 is actuated a second time. Sequencer 11 via line 24 acts simultaneously on the one hand on selector 12 which is set at b and on the other hand on divider 25 which transforms the 16 Hz input signal into a one second signal which it transmits to terminal b of selector 12. Divider 25 permits reduction of the start up time of chronometrage and increases thus its precision. Frequencies higher even that of 16 Hz may be chosen if one wishes to increase still further this precision. The minutes hand thus becomes a seconds hand and advances by 6° per second while the hours hand which is coupled thereto mechanically becomes a minutes hand and advances by 30° per minute. The position of the minutes and seconds hands is memorized and stored in counter 8 via line 13 as explained in respect of stage 1.

Fourth stage: stop chronometrage. Control means 5 is actuated a third time. The signal provided by the sequencer 11 sends a switching signal via line 24 to the selector which causes the latter to switch to d. The hands are stopped and a reading to the elapsed time may be undertaken. A signal on line 24 interrupts furthermore the operation of divider 25.

Fifth stage: return to normal display of the time of day. Control 5 is actuated for the fourth time. The signal provided thereby causes sequencer 11 to switch and provides an enable signal to comparator 23 via line 18. This enabling signal brings about two effects simultaneously:

(1) Selector 12 is switched onto c via line 19 this having as a result to provide motor 3 with a signal at 32 Hz in respect of the minutes hand.

(2) Comparator 23 compares contents A of counter 7 (stocking reference data to the hour and the minute of real time and having a capacity of $12\times60$) with contents B of counter 8 (containing reference data to the position of the hands) and causes the hands to advance until B=A. At this moment comparator 23 provides via line 19 a switching signal to selector 12 which is placed thereby into position a. Thereafter the motor receives pulses once per minute thereby causing the minutes hand to step 6° per minute and the hours hand to progress through an angle of 30° per hour.

It will be appreciated that the system proposed in its initial form is sufficient for a motor having a single rotation sense since either at the time of setting to noon (second stage) or return to display of a real time (fourth stage) the hands are always displaced in the forward direction (clockwise sense) in order to attain the new positions. In the least favorable case it will require 22.5 seconds (at 32 Hz) for the hands to arrive at the position noon or at the real time. One may reduce to half this maximum time by employing a stepping motor capable of rotating in both senses and with a circuit which will hereinafter be explained.

FIG. 3 represents the basic schematic of a circuit permitting realisation of this second form of the invention.

In this realisation the position of the hands will be located relative to a supplementary reference position at 6 o'clock. For example, in the second stage mentioned above, as is shown in FIG. 2*a*, if the hands indicate real time less than 6 hours relative to noon (for example 5 o'clock) the hands will be positioned at noon in a reverse direction according to the minus sign of the arrow while if said hands indicate real time greater than 6 hours relative to noon (for example 7 o'clock) the hands will be positioned at noon by the forward operation according to the positive sense of the arrow. In the same manner during the fourth stage as is shown in FIG. 2*b* if the hands indicate a chronometric stop situated at less than 6 hours, (for example 9 o'clock) from the real time (for example 4 o'clock) the hands will be positioned by the reverse operation onto the real time according to the negative sense of the arrow, while if the hands indicate the chronometric stop located at more than 6 hours (for instance 9 o'clock) from the real time (for instance 2 o'clock) the hands will be positioned by the forward operation onto the real time in the positive sense of the arrow. The arrangement proposed permits thus to save time since the hands will achieve the new position of departure by the shortest possible route.

In order to realise the operation mentioned above the schematic of FIG. 3 includes in addition to the arrangement described in respect of that shown in FIG. 1 and which is incorporated here in its entirety, the following additional elements: a subtractor 26 having output D, which subtracts contents A of the first counter 7 from the contents B of the second counter 8, a memory 27 storing the number of pulses corresponding to 6 hours 00 and output E, a third comparator 28 comparing the output D of subtractor 26 with output E of memory 27 and a fourth comparator 29 comparing the contents B of the second counter 8 with the output E of memory 27. The elements of the circuit are coupled together as shown in FIG. 3. As in the first form of the invention one may distinguish five stages. Only two stages 2 and 5 will be described here since they are different from those already explained above.

Second stage: positioning of the two hands at noon. Control means 5 is actuated for the first time. The signal issuing therefrom switches the sequencer 11 which on the one hand enables comparator 22 via line 14 and switches selector 12 to c via line 15, and on the other hand enables comparator 29 via line 30. Two cases may be presented:

(a) if the counter 8 storing the position of the hands indicates less than 6 o'clock the comparator 29 transmits by OR circuit 32 and by line 31 a reverse operation signal to the pulse former 4 at the same time that a countdown signal is sent to counter 8 until B=C.

(b) if the counter 8 indicates 6 o'clock or greater, comparator 29 transmits by OR circuit 32 and by line 31 a forward operation signal to pulse former 4 and at the same time a count up signal to counter 8 until B=C. In the two cases above when B=C comparator 22 sends via line 15 a switching signal to selector 12 which is switched to d. Motor 3 will then receive no further signals and stops.

Fifth stage: return to normal display of the time of day. Control 5 is actuated a fourth time. The signal which issues therefrom causes the sequencer 11 to switch, which on the one hand enables comparator 23 via line 18 and switches selector 12 to c via line 19 and on the other hand enables comparator 28 via line 33. Two cases are presented:

(a) if the subtractor 26 indicates a difference B−A smaller than 6 hours the comparator 28 sends via OR circuit 32 and line 31 a reverse operation signal to pulse former 4 and at the same time a countdown signal to counter 8. The hands thus will return to real time normal display of the hour and the minute in a counterclockwise sense until B=A.

(b) if the subtractor 26 indicates a difference B−A equal or greater than 6 hours the comparator 28 sends via OR circuit 32 and line 31 a forward operation signal to pulse former 4 and at the same time a count up signal to counter 8. The hands will return to the real time in the clockwise sense until B=A. In both cases mentioned above when B=A comparator 23 sends via line 19 a switching signal to selector 12 which places it into position a. The motor 3 then receives one pulse per minute which causes the minutes hand to step 6° each minute and the hours hand to pass through an angle of 30° per hour.

As has already been mentioned, the timepiece of this invention includes only hours and minutes hands. Since a simplified movement was required no day indication is provided. If however such should be desired means analogous to those already described can be added in order to provide a reference to the date position.

It will be appreciated that in order to provide the second form of the invention a stepping motor having two senses of rotation is required. In the case of a single pole motor the inversion of the sense of the control pulses will suffice to invert the rotation sense of the motor. In the case of a bipolar motor a special composite signal of alternating polarities will enable the obtaining of the same result.

What we claim is:

1. A timepiece comprising:

a time-standard means for providing a time standard signal of a first frequency;

a divider circuit coupled to said time standard means for receiving said time-standard signal therefrom and producing additional time signals of related frequencies;

at least one electric motor means to be driven responsive to said additional time signals;

a display means including an hours hand and a minutes hand driven by said motor means and a stationary dial having indicia thereon for indicating a noon position and the time of the day in hours and minutes;

an electric-circuit means coupled between said divider circuit and said electric motor means for utilizing said additional time signals to drive said motor means to normally indicate the time of day on said dial with said hands, but said electronic-circuit means including a movable manual control element, and having the additional function of utilizing said additional time signals: to automatically drive said motor means to move said hands to, and stop said hands at, the noon position in response to a first movement of said manual control element; to drive the minutes and hours hands from the noon position at rates at which they indicate seconds and minutes on the dial in response to a second movement of said manual control element; to stop the movement of the hands in response to a third movement of said manual control element; to reposition the hands at the actual time of day in response to a fourth movement of the manual control element; and to thereafter drive said motor means to indicate the time of day on said dial with said hands.

2. A timepiece as in claim 1 wherein said manual control element comprises a manually actuatable push-button switch and said first, second, third and fourth movements thereof comprise actuating said push-button switch.

3. A timepiece as in claim 1 wherein said electronic-circuit means includes a pulse-forming circuit with means for forming pulses derived from said additional time signals for driving said motor means.

4. A timepiece as in claim 1 wherein said electronic-circuit means employs an additional time signal of a higher frequency for driving said motor means to move said hands to said noon position in response to said first movement of said manual control element than it uses to drive said motor means to indicate the time of the day on said dial with said hands.

5. A timepiece as in claim 1 wherein said electronic-circuit means includes: a frequency selector coupled between the divider circuit and the motor means and driven by said manual control element to select an additional time signal of a particular frequency in response to a movement of said manual control element, a first counter means for storing the hour and minute of the actual time of the day and for providing a signal indicative thereof, a second counter means adapted to store the position of the hands, and providing a signal indicative thereof, a first memory storing data means indicative of the noon position of said hands on the timepiece dial and providing a signal indicative thereof, a first comparator coupled to said second counter and said first memory to receive the signals therefrom and to compare these signals for providing an output signal to indicate when the hands are at the noon position and a second comparator coupled to said first counter and said second counter to receive the signals therefrom and to compare these signals for providing an output signal to indicate when the hands are at the actual time of day.

6. A timepiece as in claim 5 wherein said electronic-circuit means further includes a subtractor arranged to receive the signals from said first and second counters and to subtract information contained in the signal from the second counter from information contained in the signal of the first counter, a second memory arranged to store the number of pulses corresponding to approximately six hours and zero (0) minutes and providing a signal indicative thereof, a third comparator for receiving the signals from the second memory and the subtractor for providing an output signal indicative of the relative positions of the hands and the actual time of day on the dial and a control circuit for receiving the output signal of the third comparator for controlling the direction of travel of said motor means to reposition said hands at the actual time of day on the dial in the shortest direction.

7. A timepiece as in claim 5 wherein said electronic-circuit means further includes a second memory arranged to store the number of pulses corresponding to approximately six hours and zero (0) minutes and a signal indicative thereof, a fourth comparator for receiving output signals from the second counter and the second memory for providing an output signal indicative of the hours hand being positioned after six hours on the dial, and a control circuit for receiving the output signal of said fourth comparator for controlling the direction of travel of said motor means to move said hands to the noon position in the shortest direction.

8. A timepiece as in claim 1 wherein said electric motor means can be driven in either of opposite directions depending upon the pulses received from said electronic-circuit means and wherein said electronic-circuit means includes a monitoring means for monitoring the positions of said hands to thereby cause said electronic-circuit means to feed appropriate pulses to said motor means for driving the motor means in a direction to move the hands to the noon position in the shortest route in response to said first movement of said control element.

9. A timepiece as in claim 8 wherein said electronic-circuit means includes a first counter for storing the hour and minute of the actual time of the day and providing a signal indicative thereof, a second counter for storing the position of the hands and providing a signal indicative thereof, a subtractor arranged to receive the signals from said first and second counters and to develope a difference signal therefrom, a second memory arranged to store the number of pulses corresponding approximately to six hours and zero (0) minutes and providing a signal indicative thereof, a third comparator for receiving the signals from the second memory and the subtractor for providing an output signal indicative of the relative positions of the hands and the actual time of day on the dial, and a control circuit for receiving the output signal of the third comparator for controlling the direction of travel of said motor means to reposition the hands at the actual time of day on the dial in the shortest direction.

10. A timepiece as in claim 8 wherein said electronic-circuit means further includes a second memory arranged to store the number of pulses corresponding to approximately 6 hours and zero (0) minutes and providing a signal indicative thereof, a fourth comparator for receiving output signals from the second counter and the second memory for providing an output signal indicative of the hours hand being positioned after six hours on the dial, and a control circuit for receiving the output signal of said fourth comparator for controlling the direction of travel of said motor means to move said hands to the noon position in the shortest direction.

11. A timepiece as in claim 10 wherein said electronic circuit means includes a subtractor arranged to receive the signals from said first and second counters and to develop a difference signal therefrom, a second memory arranged to store the number of pulses corresponding approximately to six hours and zero (0) minutes and providing a signal indicative thereof, a third comparator for receiving the signals from the second memory in the subtractor for providing an output signal indicative of the relative positions of the hands and the actual time of day on the dial, and a control circuit for receiving the output signal of the third comparator for controlling the direction of travel of said motor means to reposition the hands at the actual time on the dial in the shortest direction.

* * * * *